United States Patent [19]

Horiya et al.

[11] Patent Number: 4,652,154

[45] Date of Patent: Mar. 24, 1987

[54] THERMAL PRINTER OPERATIVE IN THREE MODES INCLUDING DIRECT PRINTING, PRINTING WITH BLACK INK RIBBON CASSETTE, AND PRINTING WITH COLOR INK RIBBON CASSETTE

[75] Inventors: Keiichi Horiya, Numazu; Kazuhide Takahama, Shizuoka; Yasuichi Kishino, Mishima; Koichiro Sato, Kitakami, all of Japan

[73] Assignee: Tokyo Electric Co., Ltd., Tokyo, Japan

[21] Appl. No.: 736,713

[22] Filed: May 22, 1985

[30] Foreign Application Priority Data

May 29, 1984 [JP] Japan ..... 59-109228

[51] Int. Cl.[4] ..... B41J 3/20

[52] U.S. Cl. ..... 400/120; 400/208; 400/225; 400/227.2; 400/229; 400/240.3; 400/240.4; 400/249; 346/76 PH

[58] Field of Search ..... 400/120, 194, 195, 196, 400/196.1, 207, 208, 208.1, 216.2, 225, 227.2, 229, 240.3, 240.4, 249, 708; 346/76 R, 76 PH

[56] References Cited

U.S. PATENT DOCUMENTS

| | | | |
|---|---|---|---|
| 3,346,090 | 10/1967 | Goff, Jr. et al. | 400/208 |
| 4,019,619 | 4/1977 | Emenaker | 400/708 |
| 4,115,013 | 9/1978 | Hedstrom | 400/249 |
| 4,231,667 | 11/1980 | Behrendt | 400/208 |
| 4,401,390 | 8/1983 | Melissa et al. | 400/249 X |
| 4,440,514 | 4/1984 | Keiter et al. | 400/208 |
| 4,468,139 | 8/1984 | Hattori | 400/208 X |
| 4,494,886 | 1/1985 | Kondo et al. | 400/208 |
| 4,502,057 | 2/1985 | Kawano et al. | 400/240.3 X |
| 4,506,273 | 3/1985 | Komatsu | 400/120 X |
| 4,511,903 | 4/1985 | Miyazaki et al. | 400/207 X |
| 4,516,137 | 5/1985 | Yasui | 346/76 PH |
| 4,530,612 | 7/1985 | Butera et al. | 400/225 X |

FOREIGN PATENT DOCUMENTS

| | | | |
|---|---|---|---|
| 3346482 | 7/1984 | Fed. Rep. of Germany | 400/240 |
| 0154193 | 12/1980 | Japan | 400/240.3 |
| 0013193 | 2/1981 | Japan | 400/208 |
| 0006786 | 1/1982 | Japan | 400/216.2 |
| 0008186 | 1/1982 | Japan | 400/216.2 |
| 0051480 | 3/1982 | Japan | 400/196.1 |
| 0173192 | 10/1982 | Japan | 400/240.3 |
| 0063494 | 4/1983 | Japan | 400/196 |
| 0094483 | 6/1983 | Japan | 400/240.3 |
| 0148779 | 9/1983 | Japan | 400/240.3 |
| 2100673 | 1/1983 | United Kingdom | 400/240.4 |

OTHER PUBLICATIONS

IBM Technical Disclosure Bulletin, "Multicolor Printing", Baker et al, vol. 22, No. 7, Dec. 1979, pp. 2633–2635.

List Continued on next page.

*Primary Examiner*—Ernest T. Wright, Jr.
*Attorney, Agent, or Firm*—Frishauf, Holtz, Goodman & Woodward

[57] ABSTRACT

A thermal printer includes a thermal head pressed against a paper sheet on a platen directly or through an ink ribbon, a carrier which holds the thermal head and on which a black or color ink ribbon is detachably mounted, a first detector for generating a color output signal upon detecting that a color ink ribbon cassette is mounted on the carrier, a second detector for generating a "black" signal while detecting a black area of the ink ribbon, and a control circuit for setting a thermal printing mode, a black or a color ink printing mode in accordance with the output signals from the first and second detectors. When the thermal printer is powered, the control circuit sets the color ink printing mode upon detecting that the color output signal is continuously generated from the first detector. When the color output signal is not generated from the first detector, the control circuit moves the thermal head by a given distance upon pressing it against the paper sheet on the platen. In this case, the control circuit sets the black ink or the thermal printing mode in accordance with the output signal from the second detector.

10 Claims, 20 Drawing Figures

OTHER PUBLICATIONS

IBM Technical Disclosure Bulletin, "Optical Means for End-of-Ribbon Sensing", Bullock et al, vol. 23, No. 9, Feb. 1981, pp. 3955-3956.

IBM Technical Disclosure Bulletin, "Low Cost Cartridge Code Detector", Craft, vol. 25, No. 4, Sep. 1982, pp. 1980-1981.

IBM Technical Disclosure Bulletin, "End-of-Ribbon Sensor and Cartridge-Present Indicator", Jenkins, vol. 27, No. 6, Nov. 1984, pp. 3645-3647.

IBM Technical Disclosure Bulletin, "Colored Ribbon Cartridge Identifier for Reduced Printing Impact", Humphreys, vol. 27, No. 7B, Dec. 1984, p. 4203.

Patent Abstracts of Japan, vol. 5, No. 61 (M-65)[733]; Apr. 24, 1981.

Patent Abstracts of Japan, vol. 8, No. 20 (M-271); Jan. 27, 1984, p. 100 M 271.

THERMAL PRINTER OPERATIVE IN THREE MODES INCLUDING DIRECT PRINTING, PRINTING WITH BLACK INK RIBBON CASSETTE, AND PRINTING WITH COLOR INK RIBBON CASSETTE

BACKGROUND OF THE INVENTION

The present invention relates to a printing device which can execute a printing operation in a direct printing mode, a black ink printing mode and a color ink printing mode.

Generally, a thermal printer using a thermal head can print directly on heat sensitive paper or can print using a thermal printing type black ink ribbon. The thermal printing and black ink printing modes are conventionally switched by a dip switch or the like.

With such a printing method, when a color ink ribbon is used instead of a black ink ribbon, the printing mode can be selected from three modes including a color ink printing mode. However, in this case, when the printing mode is switched by a dip switch as in a conventional printer, the operation becomes combersome and the printing mode may be erroneously set. In particular, if the printing mode is erroneously set when the color ink ribbon is used, color adjusting processing such as color matching cannot be performed and the advantages of color printing may be lost.

In the case of a printing method using an ink ribbon, a ribbon take-up motor is generally mounted on a carrier together with a ribbon cassette to wind the ribbon. However, this winding method requires a special purpose motor, which increases the cost. In addition, since the motor is mounted on the carrier, the load of the carrier is increased and a large carrier driving motor must be used.

SUMMARY OF THE INVENTION

It is an object of the present invention to provide a printing device which can satisfactorily and easily set three printing modes including a color ink printing mode.

In order to achieve the above object, there is provided a printing device comprising a platen for holding a paper sheet; a printing head pressed against the paper sheet on the platen in a black or color ink printing mode when the printing head is set in the ON-state; an ink ribbon being fed according to the movement of the printing head set in the ON-state; a carrier which holds the printing head and to which a black or color ink ribbon cassette is detachably mounted; a carrier driver for moving the carrier along the platen; a first detector for generating a color output signal when detecting that the color ink ribbon cassette is mounted on the carrier; a second detector, arranged in an ink ribbon path, for generating a first output signal while detecting a black area of the ink ribbon and for generating a second output signal while not detecting the black area; and a control unit which sets a color ink printing mode flag, when a power source voltage is applied to the printing device and, upon detecting that the first detector generates the color output signal, which sets the printing head in the ON-state when the power source voltage is applied to the printing device and upon detecting that the first detector does not generate the color output signal, and thereafter moves the carrier along the platen by a given distance and which respectively sets a black ink printing mode flag or a thermal printing mode flag upon detecting that the second detector continuously generates the first or second output signal while the carrier is moved by the given distance, the control unit setting the printing head in the ON-state during a printing operation and supplying character data to the printing head while moving the printing head.

According to the present invention, it can be easily checked with reference to an output signal from the first detector whether or not the color ink ribbon is set. When the printing head set in the ON-state is slightly moved, it can be easily checked in accordance with the output signal from the second detector whether or not the black ink ribbon is used or no ribbon is used. In this manner, according to the present invention, it can be easily and quickly checked if the printing mode is set in the direct printing mode, the black ink printing mode or the color ink printing mode.

DETAILED DESCRIPTION OF THE PREFERRED EMBODIMENT

Figure 1:
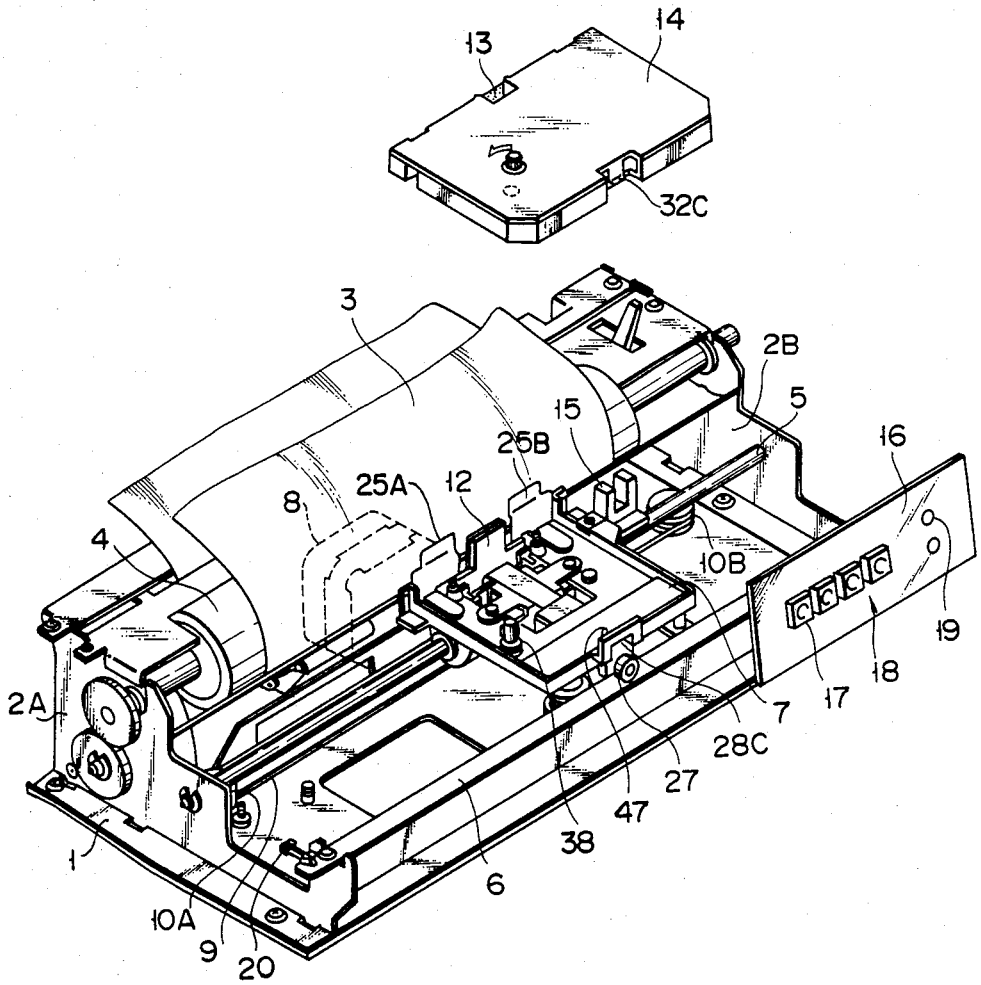
FIG. 1 is a perspective view showing a main part of a thermal printer according to an embodiment of the present invention.

A mechanism of a thermal printer according to an embodiment of the present invention will be described with reference to FIGS. 1 to 5. A drum-like platen 4 for supporting a printing paper sheet 3 which is sensitive to heat, or an ordinary printing paper, is held between side plates 2A and 2B projecting upward from the two ends of a frame 1. A rod-like guide shaft 5 and a guide plate 6 are fixed parallel to the platen 4. A carrier 7 is held by the shaft 5 and the plate 6. A belt 9 driven by a carrier motor 8 is looped between two pulleys 10A and 10B provided at the two ends of the frame 1. A portion of the belt 9 is fixed to the carrier 7.

A thermal head 12 movable toward or away from the platen 4 by a solenoid 11 is fixed to the carrier 7, and a ribbon cassette 14 housing rolls 33, 34 of an ink ribbon 13 is detachably mounted thereon. A ribbon end sensor 15 is provided on an upper surface of the carrier 7 so as to detect an end of the ribbon 13. A key assembly 18 including a print-on key 17 and a ribbon end lamp 19 are provided on an operation board 16 mounted on a front surface of the frame 1. Further, a home position switch 20 is fixed to an end portion of the guide plate 6.

Figure 5:
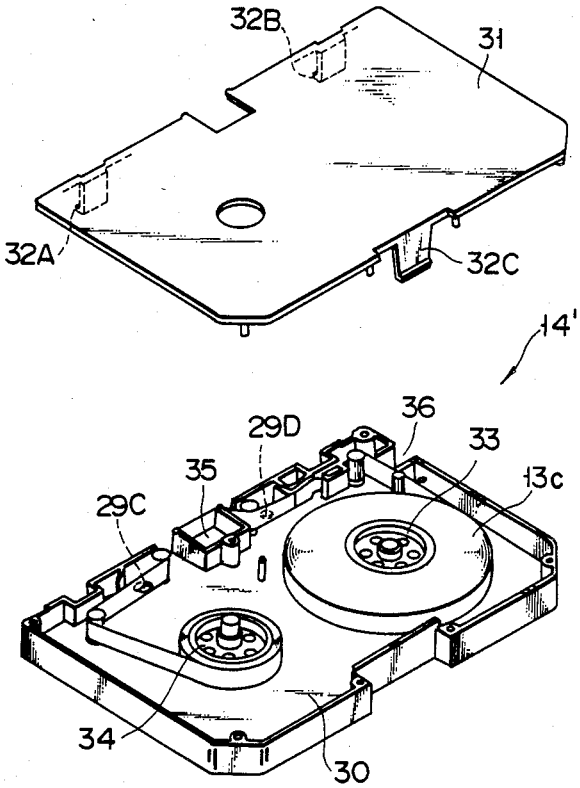
FIG. 5 is an exploded view of a color ink ribbon cassette used in the thermal printer shown in FIGS. 1 to 4.
Figure 5A:
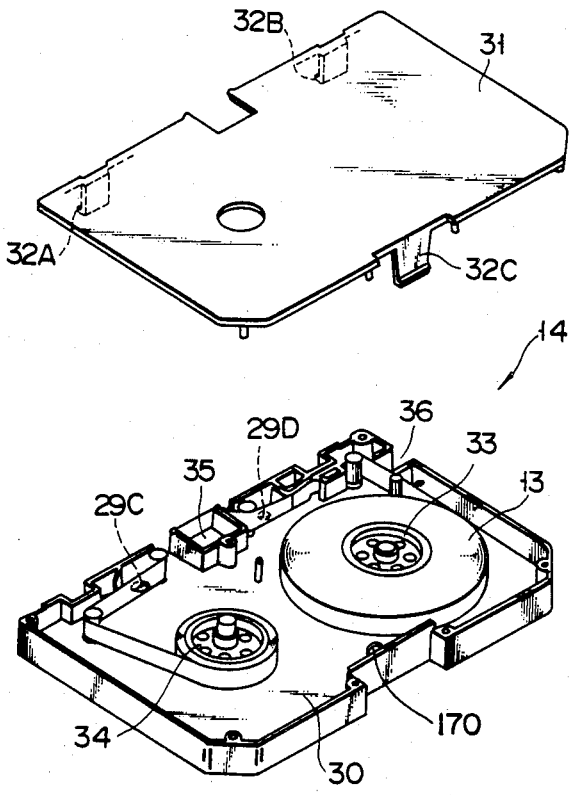
FIG. 5A is an exploded view of a black ink ribbon cassette used in the thermal printer shown in FIGS. 1 to 4.

In this embodiment, the ribbon 13 is fed or wound in synchronism with movement of the carrier 7 set in the ON-state without using a special-purpose motor. As can be seen from FIG. 2, the head 12 is arranged substantially at the center of that portion of the carrier 7 which opposes the platen 4. The head 12 is supported by a head holder 22 pivotally mounted on a supporting shaft 21 fixed to the carrier 7. The solenoid 11 is fixed to the carrier 7 through a solenoid fixing plate 23 behind the head 12. The head 12 is biased by a spring 24 provided between the plate 23 and the holder 22 in a direction away from the platen 4. Therefore, when the solenoid 11 is energized so as to push a rear surface of the holder 22, the head 12 is pressed against the platen 4. Paper guide plates 25A and 25B are fixed at two sides of the head 12. Furthermore, as shown in FIG. 3, a printed circuit (PC) board 26 is connected to the head 12, and the sensor 15 and the like is fixed on a lower surface of a rear portion of the carrier 7. A roller 27 is positioned to roll along the plate 6. The carrier 7 has three engaging portions 28A, 28B and 28C. The portions 28A and 28B are positioned at two sides of the carrier 7 so as to oppose the printing surface and the portion 28C is formed at a rear end portion of the carrier 7 behind the head 12, so that lines connecting the portions 28A, 28B and 28C substantially form a regular triangle. The cassette 14 having holes 29C and 29D aligned with guide bosses 29A and 29B on the carrier 7 comprises a case 30 and a cover 31 to hold the ribbon 13 therein, as shown in FIG. 5A. Elastic hooks 32A, 32B and 32C which elastically engage/disengage with/from the portions 28A, 28B and 28C are formed on the cover 31 so as to correspond to the positions of the portions 28A, 28B and 28C. The case 30 is provided with a ribbon supply roll 33 and a take-up roll 34. The ribbon 13 is looped between the rolls 33 and 34 so as to pass through a receiving portion 35 which receives the head 12. A receiving portion 36 is formed to receive the sensor 15.

Figure 2:
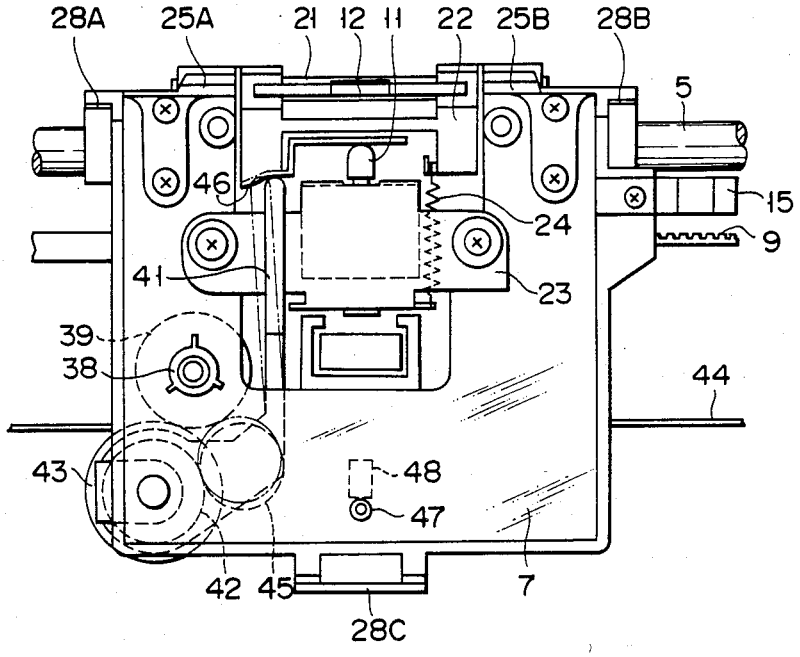
FIGS. 2 and 3 are a plan view and a partially cutaway side view of a carrier used in the thermal printer shown in FIG. 1, respectively.
Figure 3:
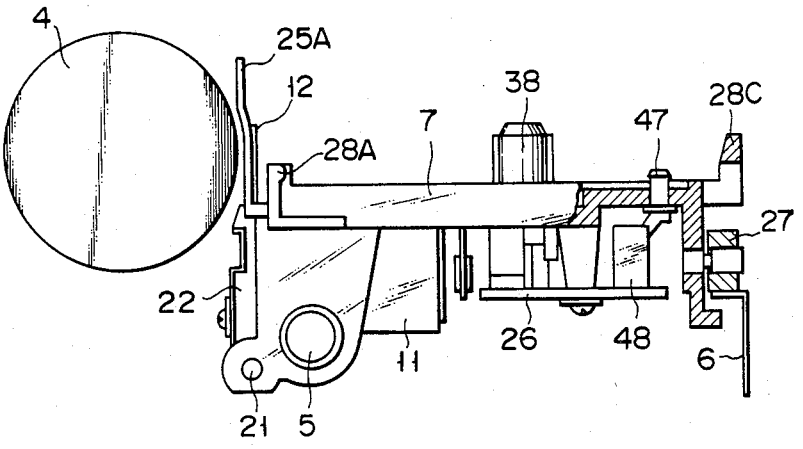
Figure 4:
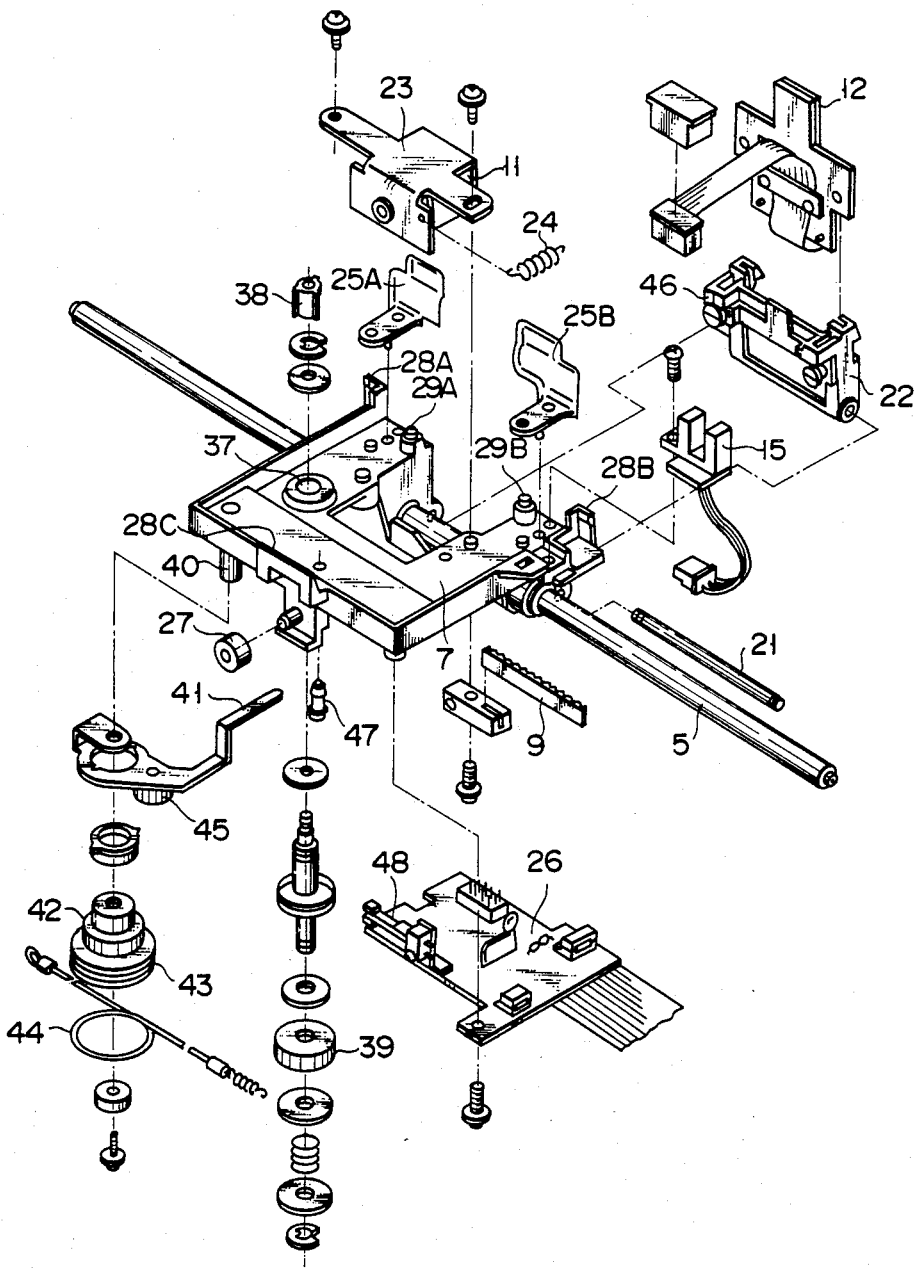
FIG. 4 is an exploded view of a mechanism including a thermal head and the carrier.

As shown in FIGS. 2 to 4, a hole 37 is formed in the carrier 7 in a position corresponding to the position of the roll 34, and a take-up shaft 38 for driving the roll 34 extends through the hole 37. A take-up gear 39 is fixed to the shaft 38 at a lower surface side of the carrier 7. A lever 41, a gear 42 and a pulley 43 which are pivotal about a guide pin 40 are mounted next to the gear 39. The gear 42 and the pulley 43 are formed integrally and a portion of a wire 44 looped between the side plates 2A and 2B is wound around the pulley 43. Therefore, the pulley 43 and the gear 42 are rotated in synchronism with running of the carrier 7. A planetary gear 45 is rotatably mounted on the lever 41. The gear 45 is always meshed with the gear 42 and is positioned behind the gear 39 so that it may engage with or disengage from the gear 39. As clearly shown in FIG. 2, the distal end of the lever 41 extends to a position of the holder 22. A regulating portion 46 contacting or separating from the distal end of the lever 41 is formed on a portion of the holder 22. As indicated by solid lines in FIG. 2, when the head 12 is not pressed by the solenoid 11, that is, it is not in contact with the platen 4, the portion 46 is brought into contact with the distal end of the lever 41 so as to prevent the lever 41 from being pivoted and to place the gear 45 in a position where it is not engaged with the gear 39. On the other hand, when the solenoid 11 is actuated and the head 12 is brought into contact with the platen 4, since the portion 46 shifts in a forward direction and the lever 41 is free from engagement, the gear 45 is displaced in accordance with the rotation of the gear 42 and is meshed with the gear 39, thus transmitting the rotation of the gear 42 to the gear 39 as shown by dash-and-two-dots lines in FIG. 2. Therefore, only when the head 12 is brought into contact with the platen 4 and the carrier 7 runs from the left to the right, the rotation of the gear 42 is transmitted to the gear 39 through the gear 45, thus rotating the shaft 38. In this manner, the ribbon 13 can be fed or wound without using a special-purpose motor. Thus, drawbacks associated with the special-purpose motor can be overcome.

In this embodiment, black and color ribbons 13, 13C can be selectively used as the ribbon. In order to allow easy determination of types of the ribbons 13, 13C, shapes of ribbon cassettes 14, 14' differ from each other for the black and color ribbons 13, 13C as discussed below with regard to FIGS. 5A and 5. A color ribbon detection switch 48 is provided on the PC board 26 so as to be turned on by an actuator 47 which is shifted downward only when the color ribbon cassette 14' is set.

With this arrangement, when the cassette 14 is set, the hooks 32A to 32C engage with the portions 28A to 28C, respectively. In this case, since these engaging positions are at the left, right and rear sides of the head 12 and substantially form a regular triangle, the cassette 14 will not be influenced by vibration of the carrier 7, a pressing operation of the head 12, and the like. Therefore, the cassette 14 can be stably held on the carrier 7 without fluttering or floating therefrom. As a result, the ribbon 13 can be stably fed or wound, thus obtaining high printing quality. Since the cassette 14 can be mounted only by engaging the hooks 32A to 32C, it can be detached or mounted by pulling it up or pressing it toward the carrier 7.

Figure 6:
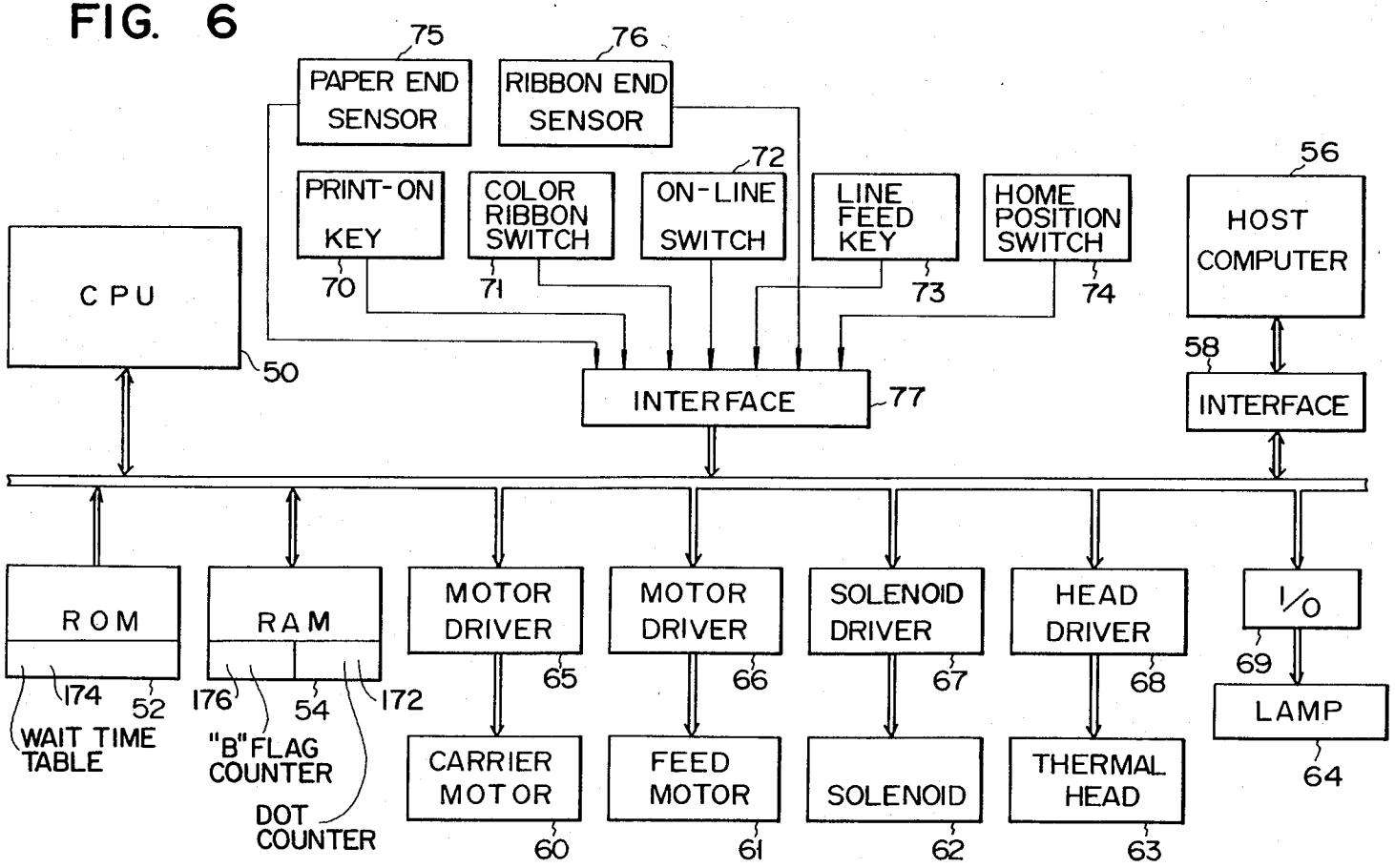
FIG. 6 is a block diagram showing a control circuit of the thermal printer shown in FIGS. 1 to 4.

FIG. 6 is a block diagram showing a control circuit of the thermal printer according to the embodiment of the present invention. The control circuit comprises a central processing unit (CPU) 50, a read-only memory (ROM) 52 storing a program to be executed by the CPU 50, and a random-access memory (RAM) 54 for temporarily storing control data transmitted from a host computer 56 via an interface 58 and printing control data obtained while executing the program. The CPU 50 is connected to a carrier motor 60, a feed motor 61, a solenoid 62, a thermal head 63 and a lamp 64 respectively through motor drivers 65 and 66, a solenoid driver 67, a head driver 68 and an I/O port 69. Note that the motor 60, the solenoid 62, the head 63 and the lamp 64 respectively correspond to the motor 8, the solenoid 11, the head 12 and the lamp 19 shown in FIGS. 1 and 2. The CPU 50 is connected to a print-on key 70, a color ribbon switch 71, an on-line switch 72, a line feed key 73, a home position switch 74, a paper end sensor 75 and a ribon end sensor 76 through an interface 77. Note that the key 70, the switches 71 and 74 and the sensor 76 respectively correspond to the key 17, the switches 48 and 20 and the sensor 15.

In this control circuit, data edit processing is executed in a main routine, and carrier driving control and printing control are executed in a time division manner in accordance with an interruption by a built-in timer. When printing conditions are established in the processing of the main routine, a carrier control routine is executed. In the carrier control routine, when a slow-up operation is completed, a printing routine is then executed.

An operation of the control circuit shown in FIG. 6 will be described hereinafter. Note that in this embodiment, a character pitch corresponds to 15 dots. In a pica pitch printing method, since a character pitch is 1/10 inch, the carrier 7 must be moved by 1/10 inch every time 15 dots are printed. Assuming that the carrier motor 60 comprises a stepping motor and the carrier 7 moves 1/30 inch upon rotation of the motor 60 by one step, the number of steps required for printing one character is $1/10 \div 1/30 = 3$ steps. Assuming that a time required for printing one dot is 1,000 μsec, a time required for printing one character is 1,000 μsec × 15 = 15 msec. Thus, a time for each step is 15 msec ÷ 3 = 5 msec, and the number of dots printed in each step is 15 dots ÷ 3 = 5 dots.

Figures 7, 9A, 9B:
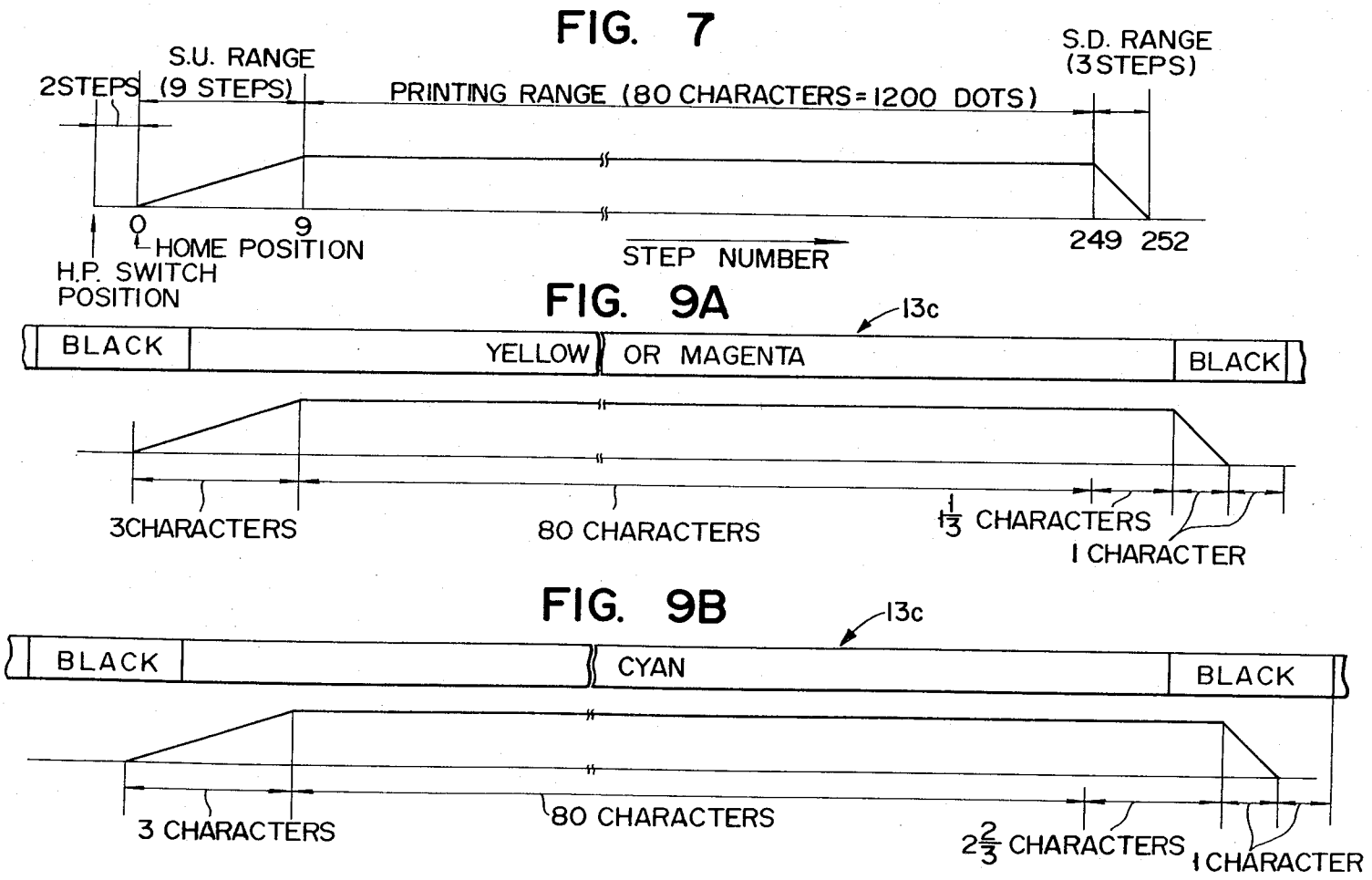
FIG. 7 is a view showing the relationship between a carrier position and a printing timing.
FIGS. 9A and 9B are views showing carrier movement with respect to respective color segments of the color ink ribbon when it is properly fed without causing any slip with respect to a paper sheet.

FIG. 7 shows the relationship between a position of the carrier 7 and a printing timing. A home position of the carrier 7 is determined at a position assumed when the motor 8 is rotated by 2 steps from a position at which the carrier 7 abuts against the switch 20. It takes a given time for the carrier 7 to be driven at a constant speed from a stop state. Furthermore, it also takes a given time to stop the carrier 7 from the constant speed state. For this reason, a slow-up range and a slow-down range respectively of three characters (=9 steps) are provided before and after the entire printing range, respectively. In this embodiment, the printing range is set for 80 characters. When 80 characters are calculated in terms of dots, they correspond to 80 × 15 = 1,200 dots, and when they are calculated in terms of the number of steps of the motor 8, they correspond to 80 × 3 = 240 steps. Although there is a difference between the dot number and the step number, control of the dot number is basically executed using a dot counter 172 which is reset to "0" when the carrier 7 moves by a distance corresponding to 3 characters (9 steps) from the home position.

A color ink ribbon 13C will be described hereinafter. In this embodiment, the ribbon 13C can be wound by utilizing movement of the carrier 7 without using a special-purpose motor. However, in this method, a ribbon take-up amount becomes inevitably uneven. This is caused by a time delay or idling of the mechanisms because the ribbon take-up mechanism constituted by the gear 45, the pulley 43, the wire 44 and the like is operated after the head 12 presses the ribbon 13 or 13C against the platen 4. Since the sliding property of the ribbon 13C depends upon the film material thereof and particular types of color pigments of the color ink ribbon 13C, the ribbon take-up amount may become unstable. Such a variation in the ribbon take-up amount is not important in the case of a black ink ribbon 13 because only a single color pigment is used. In the color ink ribbon 13C, yellow, magenta, and cyan segments each for one line are alternately arranged. When the ribbon take-up amount of the color ink ribbon 13C becomes unstable, the printing operation may be performed with a different color segment (i.e., color shift). That is, a total length of each color ribbon 13C is determined by (about 8 inches of printing range)+(carrier slow-up range)+(carrier slow-down range). If the ribbon 13C can be precisely wound, the color shift will not occur. However, when the take-up amount is insufficient, a starting portion to be printed in the next color is printed in a color used in a preceding printing cycle. On the contrary, when the ribbon 13C is excessively wound, a last portion of the line is printed in a color of the next segment.

Figure 8:
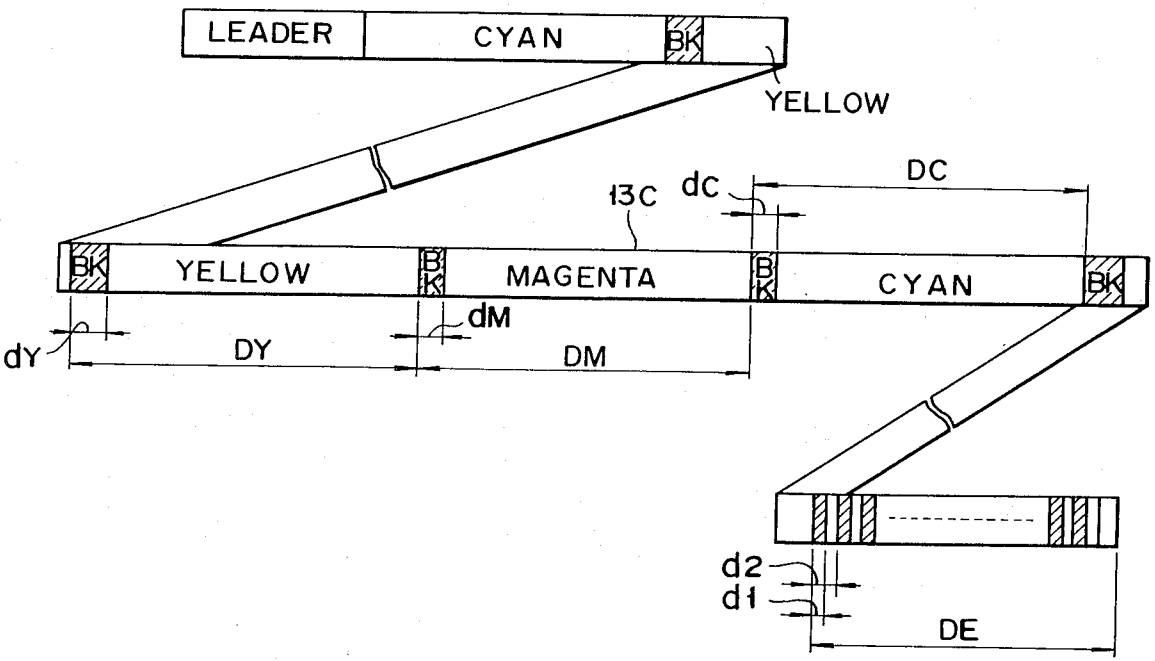
FIG. 8 is a view showing a color ink ribbon which can be used in the present invention.

In order to eliminate a variation in the ribbon take-up amount, a length of each color range of a color ink ribbon 13C is set as shown in FIG. 8. Note that before the carrier 7 starts moving, the head 12 is set in the ON-state so as to be pressed against the platen 4, and after the carrier 7 is stopped, the head 12 is set in the OFF-state so as to be separated from the platen 4. In a specific case, the head 12 can be set in the OFF-state while the carrier 7 moves. In any case, the ribbon take-up amount must be the same as the moving amount of the carrier 7 when the head 12 is in the ON-state. Yellow, magenta and cyan ribbon segments are used for the color ribbon 13C. In order to clearly distinguish these segments, a black area marker BK is provided at a leading portion of color segment. The markers BK are set to have two different lengths. A length dY of the marker BK at the leading portion of the yellow segment is set to be about 8 mm, lengths dM and dC of the markers BK at the leading portions of the magenta and cyan segments are respectively set to be about 5 mm. Thus, one set of the yellow, magenta and cyan segments can be detected, and a ribbon positioning to be described later can be executed. Note that the lengths dM and dC of about 5 mm are lower limits for permitting the marks BK to be correctly detected even if the lengths vary in a ribbon manufacturing process, and must be set to be as short as possible so as to prolong the color segment. In addition, the length dY is set to be about 8 mm because at least 3 mm is required for distinguishing the length dY from the lengths dM and dC. Lengths of the yellow, magenta and cyan color segments are set to be longer than an actual printing length (i.e., 80 characters = 8 inches ≈ 203.2 mm). Thus, when an error occurs in the ribbon take-up amount, error correction can be completed during the printing operation for one line. More specifically, a length DY of a yellow segment is set to be 220.27 mm, and lengths DM and DC of magenta and cyan segments are set to be 216.89 mm, respectively. As a result, since the slow-up range is 9 steps (≈7.62 mm), the slow-down range is 3 steps (≈2.54 mm), and the printing range for one line is 8 inches (≈203.52 mm) and the carrier 7 is adapted to move up to 223.52 mm, the carrier 7 can move within the range between 213.36 mm (i.e., the sum of (slow-up range), (printing range) and (slow-down range)) and 223.52 mm. For example, in the yellow segment, a margin of about 3.25 mm is provided to compensate for the ribbon take-up shortage, and a margin of about 6.91 mm is provided to compensate for the excessive ribbon take-up. In the magenta and cyan segments, a margin of about 6.63 mm can be provided to compensate for the ribbon take-up shortage, and a margin of about 3.53 mm can be provided to compensate for the excessive ribbon take-up. In this manner, margins in the yellow, cyan and magenta segments can be set to be the same. FIGS. 9A and 9B show a moving amount of the carrier 7 for each color segment when the ink ribbon 13C is assumed to be correctly wound.

Note that referring to FIG. 8, a lower column represents an end portion of the ribbon 13C in which a black area portion of a length d1=2.54 mm and a transparent portion of a length d2 of 5.08 mm are alternately arranged in a stripe manner for a distance DE=200 mm and which is detected by the ribbon end sensor 15 comprising a light transmitting-receiving type photocoupler. The black ink ribbon 13 also has the same ribbon end portion.

Another method for evenly taking up the ribbon 13C will be described hereinafter. Since the ribbon take-up operation is performed only when the head 12 is in the ON-state, the ON-time period of the head 12 is adjusted so as to finely adjust the ribbon take-up amount. When an error which cannot be adjusted by such fine adjustment occurs and the ribbon take-up amount is insufficient, the take-up amount is adjusted such that the carrier 7 is moved upon setting the head 12 in the ON-state independently of the printing operation. In contrast to this, when the ribbon 13C is excessively wound, the printing operation is interrupted upon detecting the black area marker of the next color segment and it is determined that the printer is in the error state. Depression of the print-on key 70 is then awaited. The error processing is executed so as to detect malfunction in the mechanism portion when the ribbon 13C is excessively wound, since excessive winding of the ribbon 13C is most frequently attributable to malfunction in the mechanism portion. Even when the ribbon 13C is excessively wound, the error processing is not executed in the following case. That is, even when the black area marker BK of the next color segment is detected due to the excessive ribbon take-up during printing of one line, if the printing operation in the current color segment is completed, the error processing is not performed, the carrier 7 is stopped and the head 12 is separated away from the platen 4.

Note that in the thermal printing and black ink printing modes, a shortest access method is adopted. In the color ink printing mode, the shortest access method is not adopted and the carrier 7 is moved for a distance corresponding to one line for feeding the ribbon 13C every printing cycle.

Operation of the printer will be described in more detail with reference to flow charts of FIGS. 10 to 16. FIG. 10 shows processing of a main routine. When the power source voltage is supplied to the printer, the RAM 54 is cleared so as to initialize the printer. Next, the home position detection processing is performed. More specifically, the carrier 7 is moved to the left, and when the home position switch 20 detects the carrier 7, the carrier motor 8 is rotated by two steps so that the carrier 7 is moved to the right and is then stopped. Then, the paper end detection processing is performed as preprocessing so as to check if the paper end is detected. Thereafter, the mode determination processing is performed.

Figure 11A:
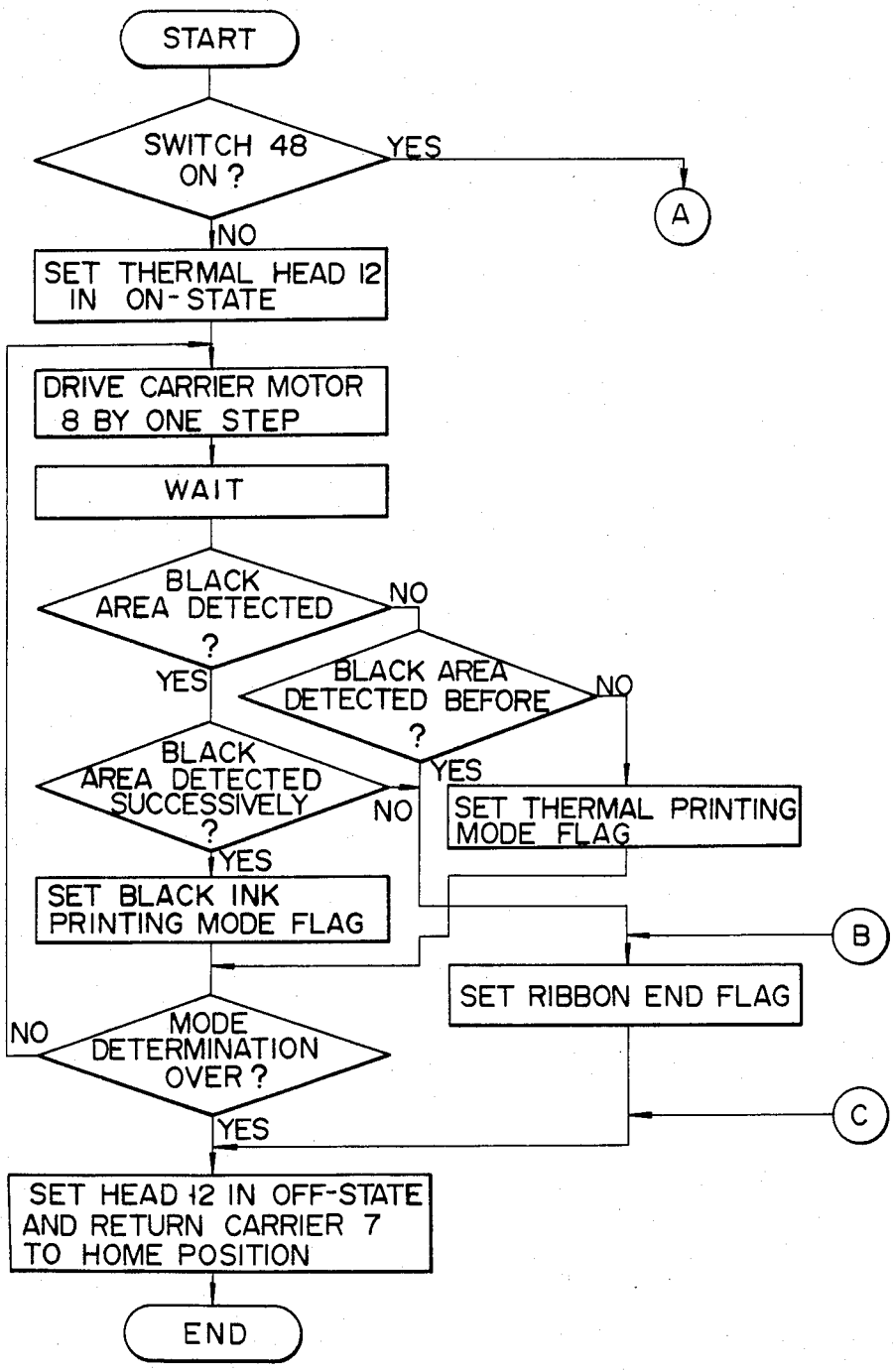
FIGS. 11A and 11B are flow charts for explaining an operation of determining printing modes.
Figure 11B:
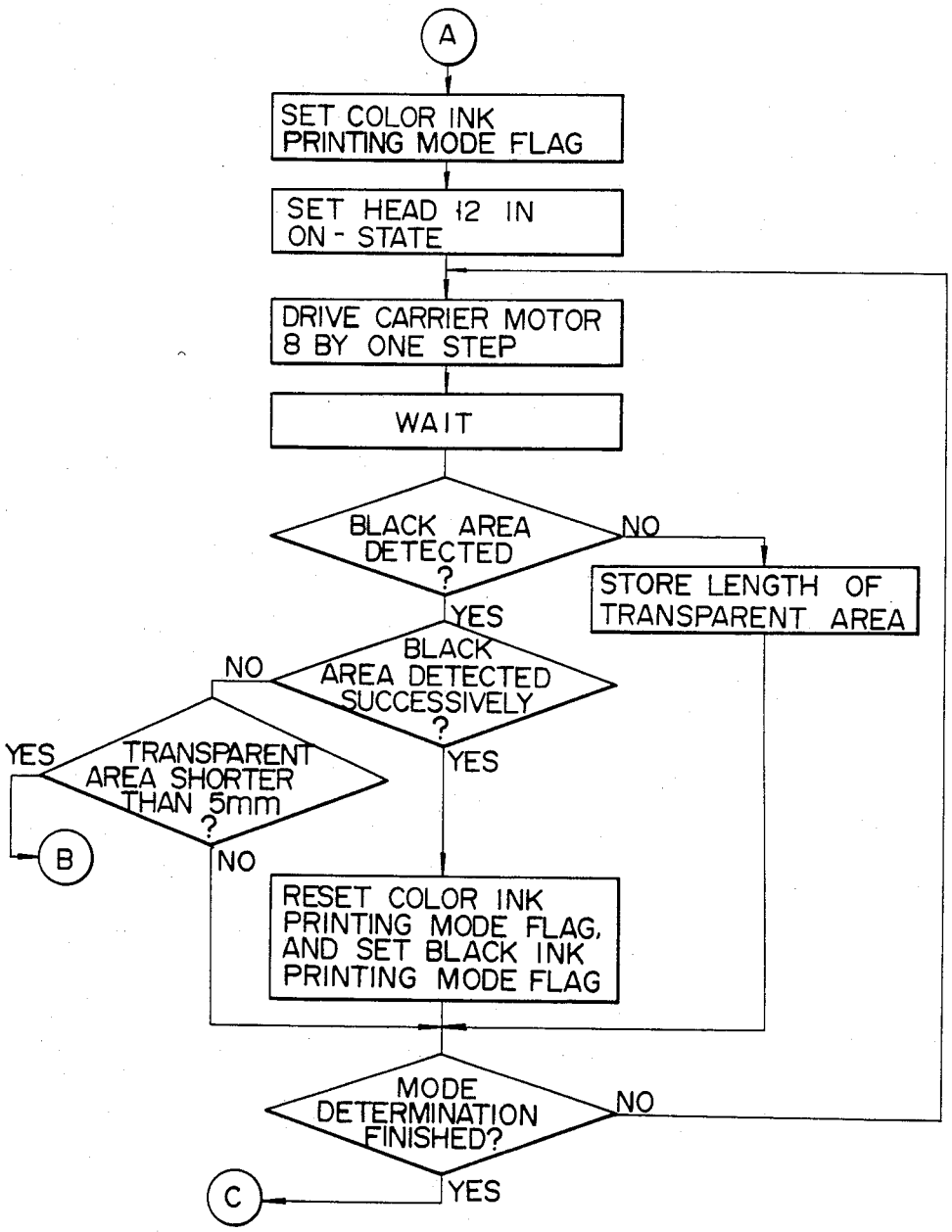

In the mode determination processing, it is checked if the thermal printing mode using heat sensitive paper 3, the black ink printing mode using the black ink ribbon 13 or the color ink printing mode using the color ink ribbon 13C is set. This processing is shown in FIGS. 11A and 11B. Referring to FIGS. 11A and 11B, it is first checked if the color ribbon detection switch 48 is turned on. As described above, since the color and black ink ribbon cassettes 14, 14' have the diffferent shapes, only when the color ink ribbon cassette 14' is set on the carrier 7, the actuator 47 is operated downward so as to turn on the switch 48. More specifically, as shown in FIG. 5A, a hole or notch 170 is formed in a portion of the black ink ribbon cassette 14 corresponding to the actuator 47 so as not to operate it. If the switch 48 is turned on, it is determined that the color ink ribbon 13C is set, and the color ink printing mode flag is set in the RAM 54. On the other hand, if the switch 48 is turned off, it is determined that the black ink ribbon cassette 14 is set or the heat sensitive paper 3 is used. In order to perform this determination, the ribbon 13 or 13C is slightly would (e.g., 25 to 30 mm) when the power source voltage is supplied to the printer irrespective of the normal printing operation. Then, the solenoid 11 is energized, and the head 12 is set in the ON-state, thus pressing it against the platen 4. The motor 8 is driven stepwise to move the carrier 7, thus winding the ribbon 13 or 13C. In this case, information of the ribbon 13 or 13C is read by utilizing the ribbon end sensor 15. When the black area is successively detected while winding about 25 to 30 mm of the ribbon 13, the CPU 50 determines that the black ink ribbon 13 is used. Thus, the black ink printing mode flag is set. On the other hand, when the heat sensitive paper 3 is used, even though the ribbon take-up operation is performed, since the ribbon 13, 13C is not present actually, no black area is detected. Thus, the thermal printing mode flag is set. When the black printing mode flag or the thermal printing mode flag is set, the motor 8 is driven by a predetermined number of steps, and it is checked if the carrier 7 is moved by 25 to 30 mm, i.e., if the mode determination operation is completed. In this case, if the CPU 50 detects that the mode determination operation is not completed, the set printing mode flag is reset and the motor 8 is driven by one step. If the CPU 50 detects that the mode determination operation is completed, the head 12 is set in the OFF-state and the carrier 7 is set to the home position. Referring to FIGS. 11A and 11B, in the "WAIT" step performed after the motor 8 is driven by one step, the wait time after which the motor 8 is next driven is determined by referring to a wait time table 174 in the ROM 52. As described above, the mode determination operation is basically performed by checking if the switch 48 is turned on, and if the sensor 15 detects the ribbon end.

In the mode determination operation, even when the switch 48 is turned on, the ribbon 13C is wound in the same manner as described above. This is performed for the ribbon end detection to be described later, and for preventing erroneous setting of the printing mode flag. In other words, when the switch 48 is turned on, it can be determined that the color ink printing mode is set.

However, when the black ink ribbon 13 is set, the switch 48 may be turned on for some reason: e.g., the black ink ribbon 13 having the same shape as that of the color ink ribbon 13C may have been inadvertently housed in the cassette 14'. Therefore, even if it is determined that the color ink printing mode is set, data of the ink ribbon 13, 13C is fetched by the sensor 15, and the CPU 50 must determine in accordance with this data whether the color or black ink printing mode is set.

Thus, while winding up the ribbon 13, 13C by 25 to 30 mm, it is checked if the black area longer than a predetermined length is detected. If more than 20 mm of the black area is detected, the CPU 50 determines that the black ink ribbon 13 is set (as shown in FIG. 8, the color ink ribbon 13C does not have the black area, e.g., longer than 20 mm) and changes the printing mode. Then, the CPU 50 resets the color ink printing mode flag and sets the black ink printing mode flag. When a transparent area is detected, a length thereof is stored in the RAM 54.

Furthermore, in this embodiment, when the printing mode is determined, the ribbon end is simultaneously determined. When the ink ribbon 13, 13C is used, the ribbon end is present. When the ribbon end is detected, the printing operation is interrupted, and the ribbon 13, 13C must be replaced. The ribbon end may be detected when the printer is powered. For this reason, the ribbon end determination is performed when the printer is powered. While the ribbon take-up operation is performed, the information of the ink ribbon 13, 13C is read by the sensor 15. The sensor 15 comprises, e.g., a photocoupler. Since light cannot be transmitted through the black ribbon 13 or the black area of the ribbon 13C and can be transmitted through other color segments, the ribbon type can be detected. When the black ribbon 13 is used, if a portion other than the black area is detected, it means that the stripe portion consisting of black and transparent areas at the ribbon end portion is detected. Thus, the CPU 50 determines that the ribbon end is detected, and sets the ribbon end flag. On the other hand, when the color ink ribbon 13C is used, since the color segments are also transparent, the ribbon end determination is performed in accordance with the lengths of the detected transparent portions. In other words, in the stripe portion, since a length of the transparent portion is short, i.e., 2.54 mm, when the detected transparent portion has a length of 5 mm or less, it is determined that the ribbon end is detected, thus setting the ribbon end flag.

When the above-mentioned detection operation ends, the head 12 is set in the OFF-state, and the carrier 7 is set to the home position.

The reason for using the switch 48 in the above-mentioned mode determination will be described. The color segments of the color ink ribbon 13C are transparent and the sensor 15 is operated as if no ink ribbon 13C is provided. Therefore, in order to determine by a conventional method whether the color ink printing mode or the thermal printing mode is selected, the ribbon 13C must be wound for a distance corresponding to one line (e.g., about 220 mm). This is because the black area between two adjacent color segments can be detected when the ribbon 13C is wound for one line. However, this results in wasting the ribbon 13C. In any mode, particularly, in the thermal printing mode, it is not preferable that the carrier 7 be moved a distance corresponding to one line every time the printer is powered. Therefore, the switch 48 is used to detect the color ink ribbon 13C by slightly winding it.

Referring again to FIG. 10A, prior to the above-mentioned mode determination, the paper end is detected. In the mode determination, in any mode the head 12 is set in the ON-state, and the ribbon 13, 13C is wound by 25 to 30 mm. In this case, when paper 3 is not set on the platen 4, the head 12 is driven upon being pressed against the platen 4 directly or through the ink ribbon 13, 13C. Since the platen 4 of the thermal printer is soft and has a very low hardness (about 25°), the load of the carrier 7 is greatly increased as compared to the case wherein the paper 3 is present. For this reason, the motor 8 may cause malfunction. In order to determine the mode prior to movement of the carrier 7, it is checked by the sensor 56 if the paper 3 is set. When the paper 3 is absent, running of the carrier 7 is inhibited. That is, the mode determination operation is not performed.

Figure 10A:
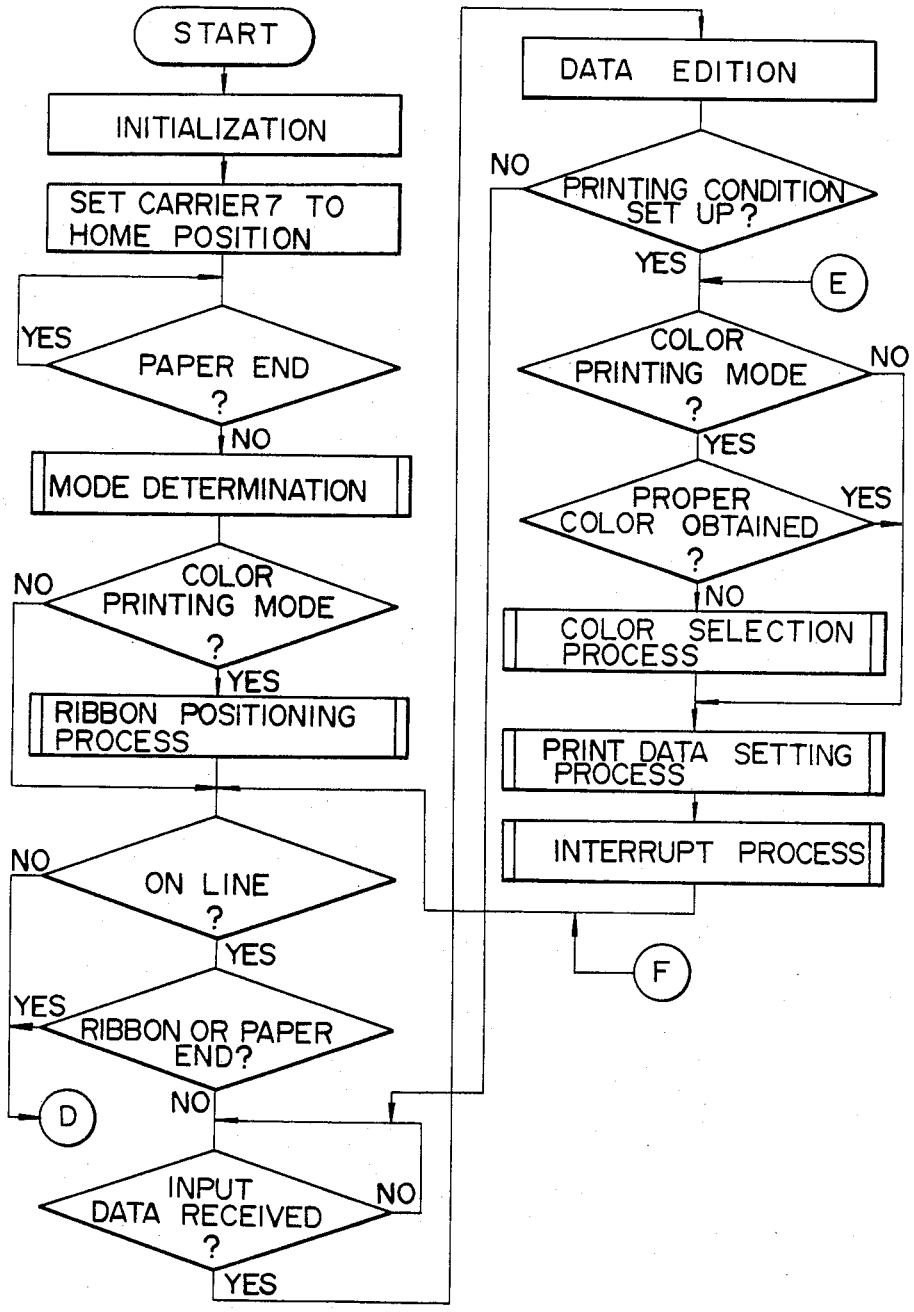
FIGS. 10A and 10B are flow charts of an operation of the CPU shown in FIG. 6.
Figure 12:
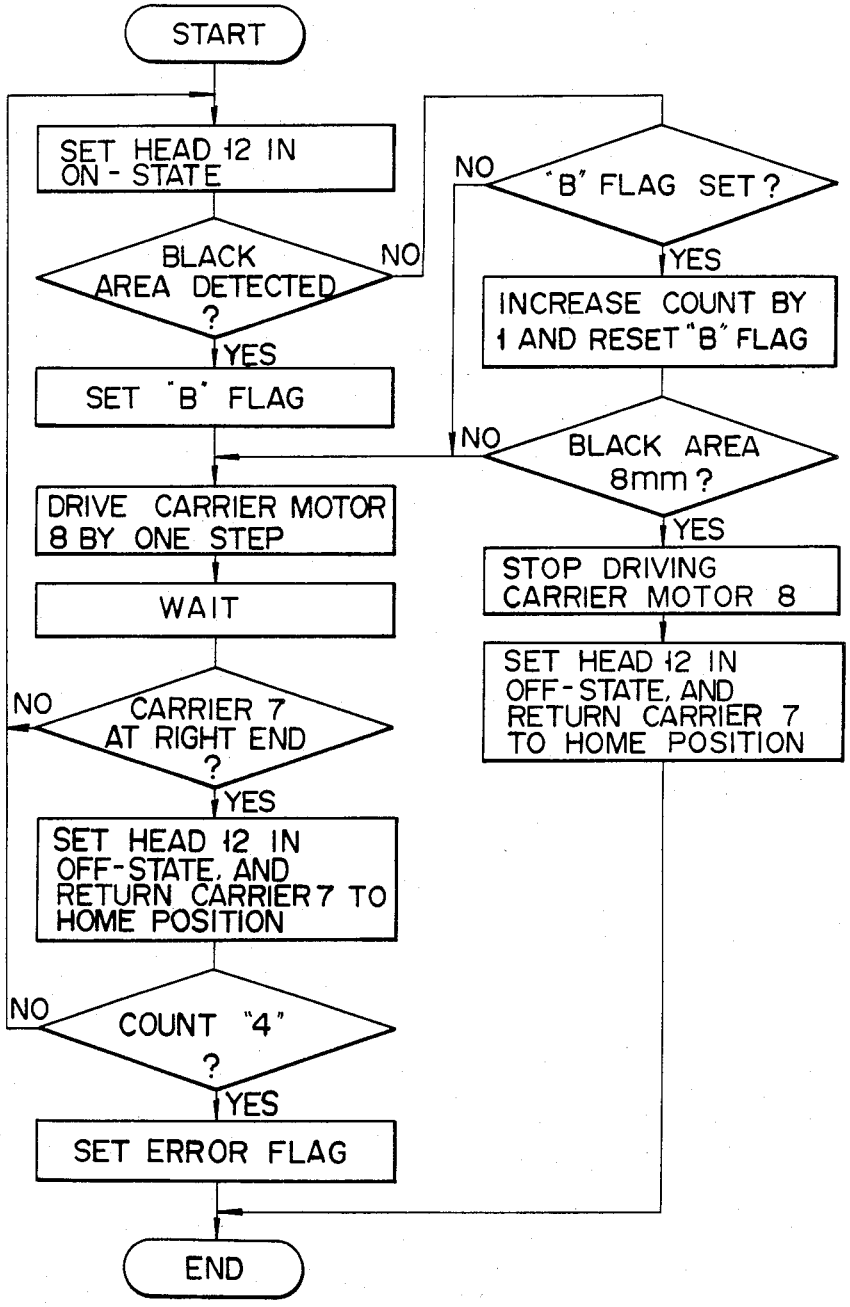
FIG. 12 is a flow chart for explaining positioning processing of the color ink ribbon.

Referring to FIG. 10A, when the mode determination operation is completed and it is determined that the color ink printing mode is set, ribbon positioning is performed. Since color printing is performed in the order of yellow, magenta and cyan, the rountine for detecting the leading portion of the yellow segment is performed. FIG. 12 shows this routine. As shown in FIG. 8, this ribbon positioning is performed by utilizing the fact that the black area marker BK of the yellow segment (about 8 mm) is longer than that of the magenta and cyan segments (about 5 mm). The head 12 is set in the ON-state, thus establishing the ribbon feed enable state. It is determined if the sensor 15 detects the black area. If the black area is detected, "B" flag is set so as to count the number thereof by the counter 176 in the RAM 54, and the carrier 7 is moved to the right end. Thereafter, the head 12 is set in the OFF-state, and the carrier 7 is moved to the left so as to be set to the home position. When such an operation is repeated several times, every time the black marker BK is detected, i.e., every time the transparent area is detected immediately after the black area, the number of the black markers BK is counted and the "B" flag is reset. In addition, the length of the black marker BK is determined. If the black marker BK is about 8 mm in length, it is the one at the leading portion of the yellow segment, and the ribbon positioning is performed. Thus, the motor 8 is stopped, and the head 12 is set in the OFF-state. Thereafter, the carrier 7 is returned to the home position, thus enabling printing. On the other hand, when the fourth black marker BK is detected and it does not have a length of about 8 mm, this may indicate a mechanical error, and the error flag is set. In this manner, the black area of the leading portion of the yellow segment is different from those of other segments, one set of color segments (yellow, magenta and cyan) can be easily detected, and the ribbon positioning can be easily performed.

The processing up to the ribbon positioning routine corresponds to preset processing.

Referring to FIG. 10A, after the preset processing ends, the flow enters the main routine, and it is checked if the printer is set in a printing enable state. First, it is checked if the printer is in the on-line state (if in the off-line state, printing is disabled), and it is then checked if the paper end or ribbon end is detected. Thereafter, it is checked if data from the host computer 56 is present, and if YES in this step, the flow enters in a data edition routine. Thus, the data sent from the host computer 56 is analyzed and edited, and it is checked if the printing conditions are set up. If the printing conditions are satisfied, in the color ink printing mode, color adjustment is performed. When a color to be currently printed is yellow, it is not necessary to change the ribbon position which has been set in the ribbon positioning process. However, for example, when printing operation is to be started from the magenta segment in accordance with an instruction from the host computer 56, the ribbon 13C must be wound up to the leading portion of the magenta segment. In a print setting routine, a moving range of the carrier 7 is determined, the motor step number is calculated, printing data from the beginning of the printing up to the end is set, and a print start time is calculated. Thereafter, interrupt processing is executed so as to drive the carrier 7. Note that interrupt processing for driving the printer is executed during execution of interrupt processing for driving the carrier 7.

On the other hand, when the printer is in the off-line state and the line feed key 73 is depressed, line feed processing of the paper 23 is performed. Then, it is checked if a select key (print-on key 17) is depressed for restarting printing after the ribbon end was detected. In the color ink printing mode, the ribbon positioning is performed, as described above. Thereafter, it is checked if the ribbon positioning is properly performed. Thus, preparation for resuming printing is performed after interrupting printing.

Figure 13:
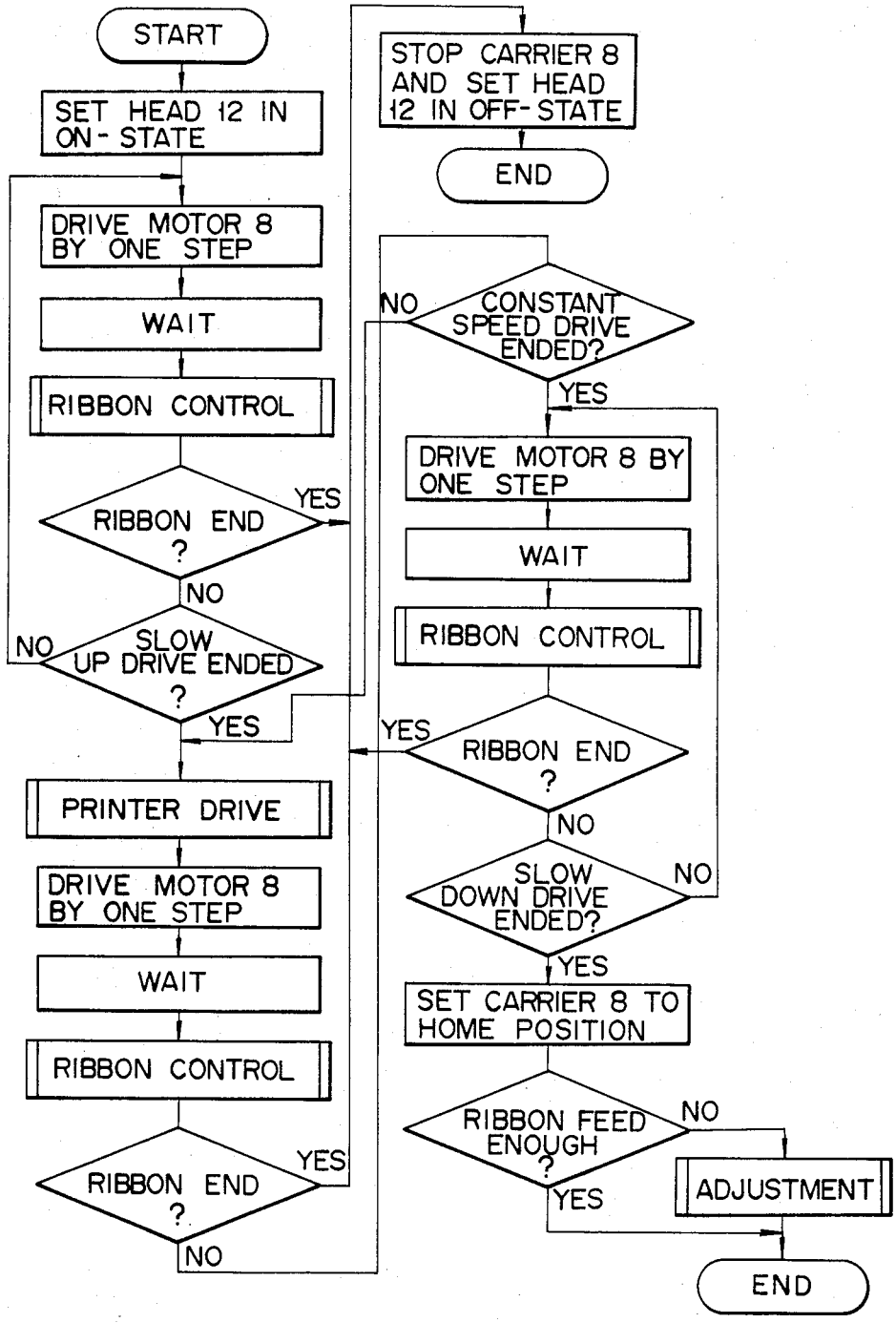
FIG. 13 is a flow chart for explaining a carrier driving operation.
Figure 14:
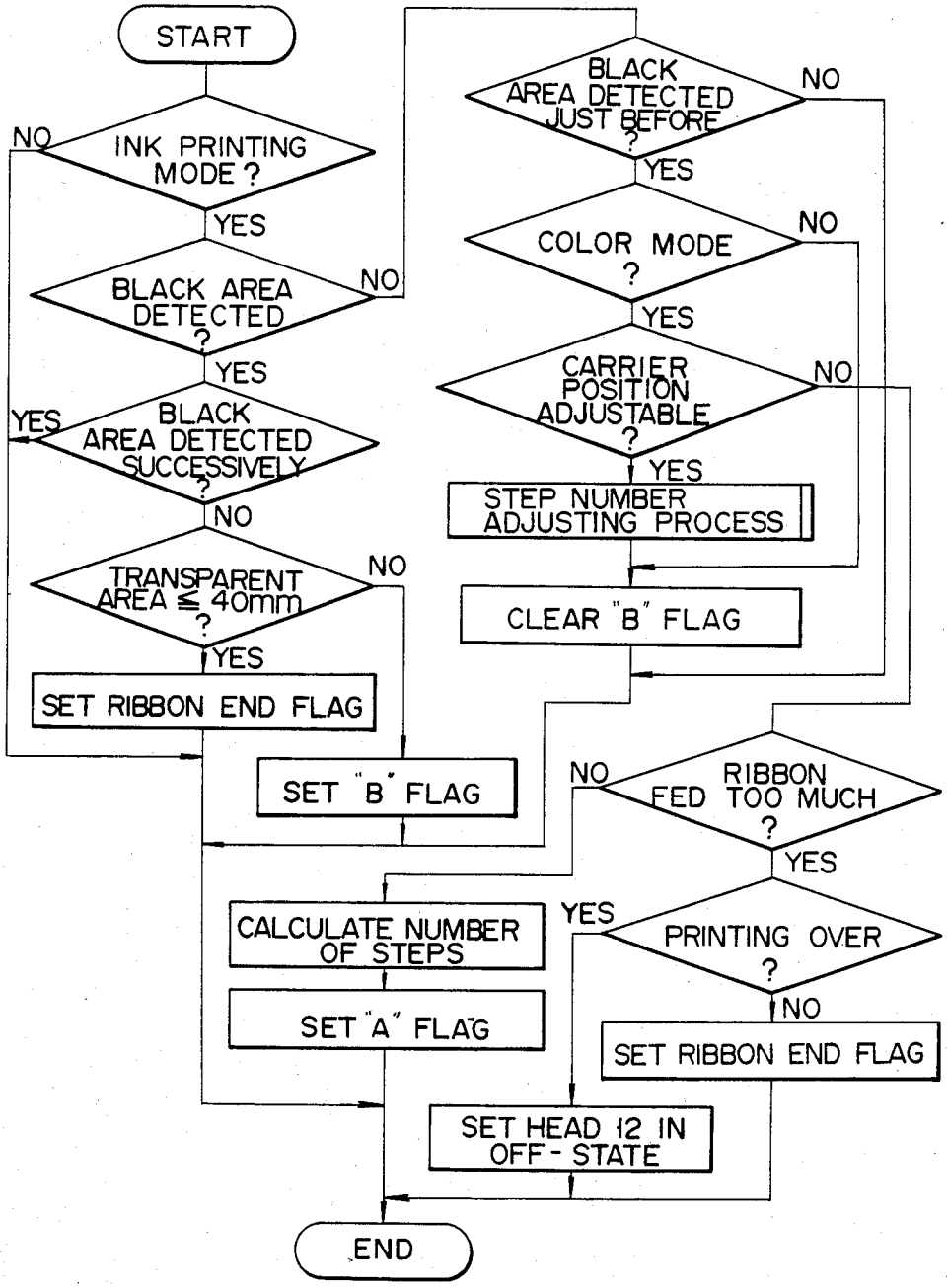
FIG. 14 is a flow chart for explaining ribbon control processing.

Operation of the carrier 7 will be described with reference to a flow chart of FIG. 13 for explaining the operation of the carrier motor 60. As can be seen from FIG. 13, the carrier 7 is driven in accordance with a slow-up routine, a constant speed routine, and a slow-down routine. In any routine, every time the motor 8 is rotated by one step, the ribbon end is monitored, and when the ribbon end is detected, the carrier 7 is stopped and the head 12 is set in the OFF-state. Every time the motor 8 is rotated by one step, ribbon control is also performed. As shown in FIG. 14, the ribbon control is executed so as to prevent a color shift due to a variation in the ribbon take-up amount in the color ink printing mode.

Figure 15:
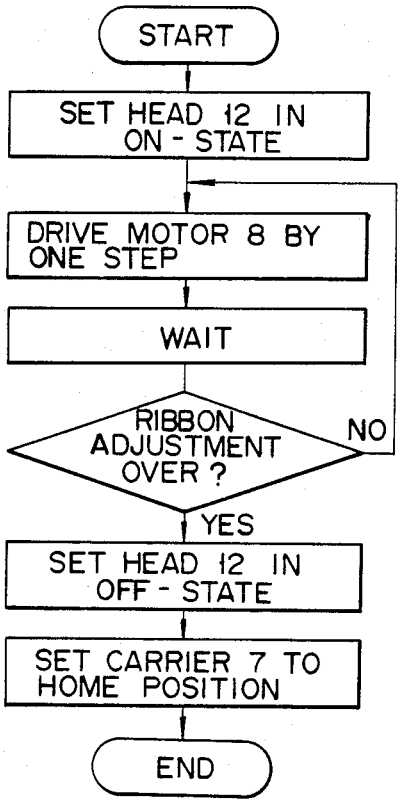
FIG. 15 is a flow chart for explaining fine adjustment processing of the ribbon.

The ribbon control will be explained with reference to FIG. 14. When the printer is set in the thermal printing mode or black ink printing mode, the flow ends. Once it is detected that the black area is shifted to the transparent area, a length of an area other than the black area, i.e., the transparent area is calculated. If the length is 40 mm or less, the ribbon end flag indicating the stripe portion of the ribbon end is set. On the other hand, if the length of the transparent area is 40 mm or more, it is determined that the color ribbon 13C is effectively set. Thereafter, when the black area marker BK is detected, the "B" flag is set. After the black area marker BK is detected and then the next transparent is detected, if it is determined that the color ink printing mode is set, the CPU 50 checks if the carrier 7 is in a fine adjustable range. In other words, since the tolerance is provided with respect to a proper take-up amount, as illustrated in the ribbon arrangement in FIG. 8, when the error of the take-up amount falls within ±3.25 mm, the step number of the carrier 7 is increased or decreased, thus performing the fine adjustment. In accordance with an increase or decrease in the step number, the fine adjustment processing shown in FIG. 15 is performed. More specifically, when the motor 8 is driven by the calculated number of steps upon setting the head 12 in the ON-state, the ribbon 13C is further fed by the take-up shortage amount. Thereafter, the head 12 is set in the OFF-state, and the carrier 7 is returned to the home position. Then, the "B" flag is cleared. When an error exceeding the fine adjustable range occurs, the processing is divided into two routines for insufficient and excessive take-up. When the ribbon 13C is wound insufficiently by 3.25 mm or more, the step number of the carrier motor 60 corresponding to the take-up shortage amount is calculated and the additional take-up flag is set. As shown in FIG. 13, the additional take-up processing is executed in such a manner that the carrier 7 is moved by a desired amount after being returned to the home position. Therefore, this additional take-up processing differs from the take-up amount fine adjustment performed at the right end position. On the other hand, when the ribbon 13C is wound by 3.25 mm or more, the following two operations are performed. When the black area marker BK of the leading portion of the color segment appears and the printing operation for the line in the current color segment is already completed, the head 12 is set in the OFF-state, the ribbon take-up operation is stopped, and this state is not regarded as an error. However, when the black area of the next color segment is detected during the printing operation in the current color segment, the printing operation, the movement of the carrier 7 and the ribbon take-up operation are interrupted due to an error. In this case, the ribbon end flag is set. This is because in the main processing and the off-line processing, the same processing is performed after the insufficient ribbon take-up occurs and after the ribbon end is detected.

Figure 16:
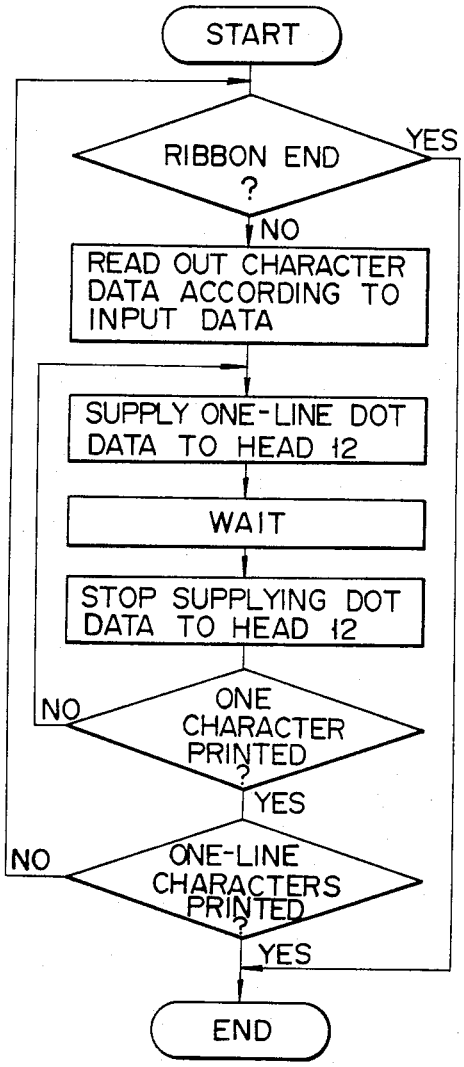
FIG. 16 is a flow chart for explaining a printing operation.

Note that FIG. 16 shows a printing routine for printing by controlling an output of the head 12. Referring to FIG. 16, the CPU 50 checks if the ribbon 13, 13C has not reached the ribbon end, and thereafter, sequentially reads out character data from the ROM 52 in accordance with input data received from the host computer 56 so as to supply them to the head 12. When the character data for one line has been printed, the printing routine ends.

Figure 10B:
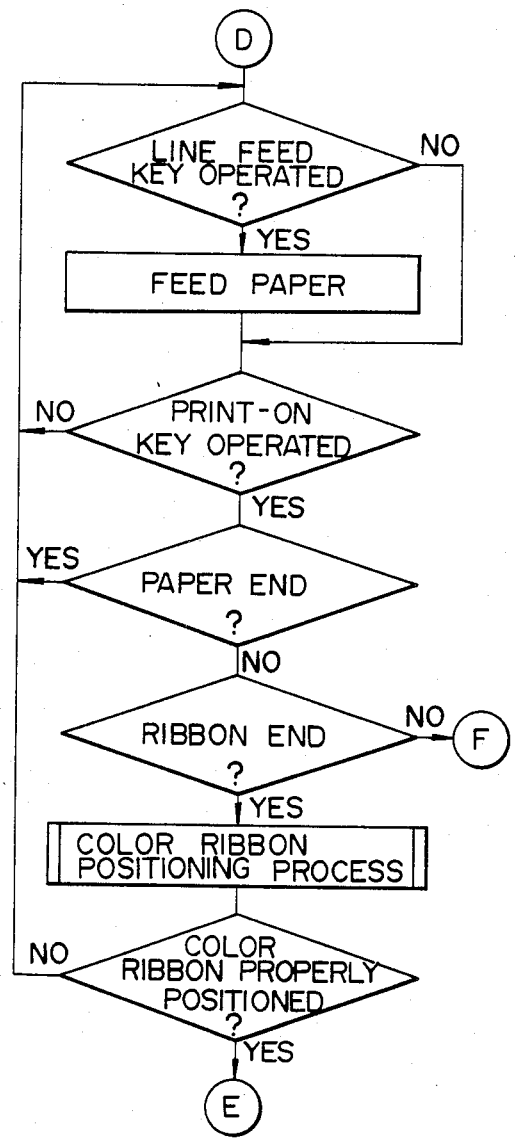

In this manner, in this embodiment, the ribbon end is always detected. Since the ink ribbon 13, 13C is of a one-time ribbon type, when the ribbon end is detected, the ink ribbon 13, 13C, i.e., the ribbon cassette 14, 14' must be replaced. Processing to be performed upon detecting the ribbon end during the printing operation will be explained hereinafter. The same processing can be applied to the black ink and the color ink printing modes. When the ribbon end is detected, the printing operation is immediately stopped, and the carrier 7 is moved to the center and is then stopped. Thus, a new ribbon cassette 14, 14' is set on the carrier 7. In this case, since the carrier 7 is stopped at the center, the replacement can be easily performed. Thereafter, when the print-on key 17 is depressed, the printing operation can be restarted from a position at which the printing operation was interrupted when the ribbon end was detected. More specifically, when the key 17 is depressed, the carrier 7 is returned from the center to the home position and is moved from the home position to the position at which the printing operation was interrupted. In respect of the printing dots, the printing dot position at which the printing operation is interrupted can be determined with reference to a dot counter "0" position separated from the home position by the number of dots corresponding to 3 characters. In the color ink printing mode, before the printing operation is resumed, the same color segment as that which is set when the printing operation is interrupted must be detected. As shown in FIGS. 10A and 10B, after the new color ink ribbon 13C is set, the ribbon positioning is performed, and thereafter, the ribbon 13C can be wound for selecting the same color segment as that which is set when the printing operation is interrupted before restarting the printing operation. Therefore, in the printing output, the printed data before and after the interruption cannot be distinguished from each other as if the ribbon replacement has not been performed during the printing operation, thus providing high printing quality. The printing quality can be further improved since the printing operation is not restarted from the beginning of the line by printing the printed data again.

This invention has been described with reference to the disclosed embodiment. However, this invention is not limited to this embodiment. For example, in the embodiment described above, a thermal printer is used, but it is possible to use an impact printer which may employ pressure sensitive paper, black and color ink ribbons.

What is claimed is:

1. A printing device capable of operating in a selected one of a thermal, a black ink ribbon and a color ink ribbon printing mode, comprising:

a frame;

a platen suported on said frame for holding a paper sheet;

a printing head, and means to press the printing head toward the paper sheet held by said platen when set in an ON-state;

a carrier for supporting said printing head, said means to press the printing head and a selected one of a black ink and a color ink ribbon cassette having, respectively, an associated ink ribbon, wherein a selected cassette can be detachably mounted on said carrier and the associated ink ribbon is then fed between said printing head and the paper sheet held by said platen;

driver means for moving said carrier along the direction of said platen, and ink ribbon feeding means to feed said associated ink ribbon when a selected cassette is mounted on said carrier;

first detecting means associated with said carrier for generating a color output signal upon detecting that a color ink ribbon cassette is mounted on said carrier;

second detecting means, arranged along the cassette ink ribbon path, for generating a first output signal while detecting a black area of the associated ink ribbon and for generating a second output signal while not detecting a black area of the associated ink ribbon; and control means coupled to said first and said second detecting means to establish a test mode when at least one of the conditions of powering said printing device and putting said printing device in an ON-line mode occurs, for (a) setting color ink printing mode flag upon detecting that the color output signal is generated from said first detecting means, (b) actuating said ink ribbon feeding means to operate in a manner capable of feeding the associated ink ribbon by a given ribbon length and (c) setting a selected one of a black ink printing mode flag and a thermal printing mode flag for direct printing on heat sensitive paper upon detecting, respectively, that the first or the second output signal is continuously generated from said second detecting means during actuation of the ink ribbon feeding means, said control means establishing a printing mode after said test mode for setting said printing head in the ON-state in the printing mode and supplying character data to said printing head while causing said printing head to be moved while printing on the paper sheet.

2. A printing device according to claim 1, wherein the control means replaces the color ink printing mode flag with a black ink printing mode flag only if the first output signal is continuously generated from the second detecting means for said given length of ink ribbon feed.

3. A printing device according to claim 2, wherein the ink ribbon has a plurality of alternately arranged black areas and transparent areas each having a predetermined length at an end portion thereof, and said control means sets a ribbon end flag upon detecting the end portion of the ink ribbon in accordance with the first and second output signals from said second detecting means.

4. A printing device according to claim 3, further comprising third detecting means for generating a paper-on signal while detecting that the paper sheet is set on said platen, said control means inhibiting driving of said carrier upon detecting that the paper-on signal is not generated from said third detecting means when said printing device is powered.

5. A printing device according to claim 3, wherein said ink ribbon feeding means comprises rotation means detachably coupled with a ribbon take-up roll of a selected ink ribbon cassette and coupled to said driving means for converting linear movement of said carrier into rotation movement to rotate said rotation means when said printing head is set on the ON-state.

6. A printing device according to claim 2, further comprising third detecting means for generating a paper-on signal while detecting that the paper sheet is set on said platen, said control means inhibiting driving of said carrier upon detecting that the paper-on signal is not generated from said third detecting means when said printing device is powered.

7. A printing device according to claim 2, wherein said ink ribbon feeding means comprises rotation means detachably coupled with a ribbon take-up roll of a selected ink ribbon cassette and coupled to said driving means for converting linear movement of said carrier into rotation movement to rotate said rotation means when said printing head is set on the ON-state.

8. A printing device according to claim 1, further comprising third detecting means for generating a paper-on signal while detecting that the paper sheet is set on said platen, said control means inhibiting driving of said carrier upon detecting that the paper-on signal is not generated from said third detecting means when said printing device is powered.

9. A printing device according to claim 1, wherein said ink ribbon feeding means comprises rotation means detachably coupled with a ribbon take-up roll of a selected ink ribbon cassette and coupled to said driving means for converting linear movement of said carrier into rotation movement to rotate said rotation means when said printing head is set on the ON-state.

10. A printing device according to claim 1, wherein the associated ink ribbon has a plurality of alternately arranged black areas and transparent areas each having a predetermined length at an end portion thereof, and said control means sets a ribbon end flag upon detecting the end portion of the associated ink ribbon in accordance with the first and second output signals from said second detecting means.

* * * * *